US008651183B2

(12) United States Patent
Guerrero et al.

(10) Patent No.: US 8,651,183 B2
(45) Date of Patent: Feb. 18, 2014

(54) ROBOTIC EXPLORATION OF UNKNOWN SURFACES

(75) Inventors: Julio Guerrero, Cambridge, MA (US); Steve Dubowsky, Boston, MA (US); Francesco Mazzini, Cambridge, MA (US); Dan Kettler, Cambridge, MA (US)

(73) Assignees: Schlumberger Technology Corporation, Sugar Land, TX (US); Massachusetts Institute of Technology, Cambridge, MA (US)

( * ) Notice: Subject to any disclaimer, the term of this patent is extended or adjusted under 35 U.S.C. 154(b) by 1100 days.

(21) Appl. No.: 12/534,063

(22) Filed: Jul. 31, 2009

(65) Prior Publication Data

US 2011/0029289 A1 Feb. 3, 2011

(51) Int. Cl.
*E21B 47/00* (2012.01)
*E21B 47/09* (2012.01)

(52) U.S. Cl.
USPC ..... 166/255.2; 166/255.1

(58) Field of Classification Search
USPC ..... 166/255.1, 255.2; 175/4.51; 702/6, 7, 9, 702/10, 11
See application file for complete search history.

(56) References Cited

U.S. PATENT DOCUMENTS

| | | | | |
|---|---|---|---|---|
| 4,302,881 | A * | 12/1981 | Schwind et al. | 33/544.3 |
| 4,542,328 | A * | 9/1985 | Pouyet | 318/573 |
| H1115 | H | 12/1992 | Nachbar | |
| 5,427,177 | A | 6/1995 | Jordan, Jr. et al. | |
| 5,737,277 | A * | 4/1998 | Priest | 367/27 |
| 6,012,527 | A | 1/2000 | Nitis et al. | |
| 6,349,768 | B1 | 2/2002 | Leising | |
| 6,568,469 | B2 | 5/2003 | Ohmer et al. | |
| 6,953,091 | B2 | 10/2005 | Volpert | |
| 7,076,335 | B2 | 7/2006 | Seemann | |
| 7,832,488 | B2 | 11/2010 | Guerrero et al. | |
| 2004/0099175 | A1 | 5/2004 | Perrot et al. | |
| 2006/0137874 | A1 | 6/2006 | Araque et al. | |
| 2008/0135293 | A1* | 6/2008 | Tashiro et al. | 175/45 |
| 2008/0275648 | A1* | 11/2008 | Illfelder | 702/7 |
| 2009/0007444 | A1* | 1/2009 | Shibata | 33/200 |

OTHER PUBLICATIONS

Allen et al., "Acquisition and interpretation of 3-D sensor data from touch,", IEEE Trans. Robotoics and Automation, 1990, vol. 6(4): pp. 33-40.

Beccari et al., "Pose-independent recognition of convex objects from sparse tactile data," Proceedings of the 1997 IEEE Conference on Robotics and Automation, Apr. 1997: pp. 3397-3402.

Casselli et al., "Efficient exploration and recognition of convex objects based on haptic perception," Proceedings of the 1996 IEEE International Conference on Robotics and Automation, Apr. 1996: pp. 3508-3513.

Chew, "Guaranteed-quality mesh generation for curved surfaces," 9th Annual Symposium on Computational Geometry, 1993: pp. 274-280.

(Continued)

*Primary Examiner* — Cathleen Hutchins
(74) *Attorney, Agent, or Firm* — Bridget Laffey; Rachel E. Greene; Jakub Michna

(57) ABSTRACT

The subject matter describes a tactile sensing device comprising an end effector and a control unit. The control unit is capable of receiving tactile information from the at least one end effector. The device enables a user to identify and relatively quickly map the shape and location of unknown surfaces.

24 Claims, 8 Drawing Sheets

(56) References Cited

OTHER PUBLICATIONS

Keren et al., "Recognizing 3D objects using tactile sensing and curve invariants," Journal of Mathematical Imaging and Vision, 2000, vol. 12: pp. 5-23.

Petitjean et al., "A survey of methods for recovering quadrics in triangle meshes," ACM Computing Surveys, Jun. 2002, vol. 34(2): pp. 211-262.

Pribadi et al., "Exploration and dynamic shape estimation by a robotic probe," IEEE Transactions on Systems, Man, and Cybernetics, Jul./Aug. 1989, vol. 19(4): pp. 840-846.

Roberts, "Robot active touch exploration: constraints and strategies," Proceedings IEEE International Conference on Robotics and Automation, 1990: pp. 980-985.

Schneiter, "Automated tactile sensing for object recognition and localization," Ph.D. Thesis, Department of Mechanical Engineering, MIT, 1986: pp. 1-147.

Vosniakos et al., "Reverse engineering of simple surfaces of unknown shape with touch probes: scanning and compensation issues," Proc. Instn. Mech. Engrs., J. Engineering Manufacture, 2003, vol. 217 Part B: pp. 563-568.

* cited by examiner

ROBOTIC EXPLORATION OF UNKNOWN SURFACES

BACKGROUND OF THE INVENTION

1. Field of the Invention

The subject matter disclosed relates generally to the location and entry of a lateral hydrocarbon well from a main wellbore in a subterranean formation. More particularly, the subject matter disclosed relates to a robot capable of identifying unknown surfaces in a wellbore.

2. Background of the Invention

Multilateral hydrocarbon wells i.e. hydrocarbon wells having one or more secondary wellbores connecting to a main wellbore, are common in the oil industry. Location, or location and entry of one or more of the secondary or lateral wellbores, whether in completion or treatment procedures for a new well, or for reconditioning or reworking of an older well often can pose as a problem for the well service operator.

In addition, world oil demand and advance recovery techniques have made it economically attractive to rehabilitate previously abandoned oil wells. Rehabilitating requires lowering instruments and tools into the wells. These wells often have a number of junctions where divergent branches leave the main well at unrecorded depths. These junctions were not intended to be re-entered after their construction. To rehabilitate a divergent branch, the location and shape of its junction must be determined. The data acquisition to map a junction must be completed quickly given the high cost of keeping a well out of service.

Well mapping is challenging because the opaque fluids that fill the well to avoid its collapse prevent the use of visual sensors to measure the junction. Frequently, a layer of "mud cake" often obscures the well bore surface.

Past research on tactile characterization of unknown geometries has considered a number of approaches. In an early study, a tactile exploration technique for locating and identifying a 2D object among a library of known objects is developed (Schneiter, J. "Automated Tactile Sensing for Object Recognition and Localization. Ph.D. Thesis, Department of Mechanical Engineering, MIT, 1986). In this work, a tree of object identity hypotheses is made and the search for the next data point is selected to maximize the potential of pruning this tree. The method has been extended to 3D polygonal objects (Roberts, K., "Robot active touch exploration: constraints and strategies." Proc. IEEE Int. Conf. Robotics and Automation 980-985, 1990). This method cannot handle unknown geometries because it relies on a library of specific objects.

Approaches for general, unknown objects have been developed. A common approach is based on the description of a surface with a mesh. (Caselli et al., "Efficient Exploration and recognition of convex objects based on haptic perception", Proc. IEEE Int. Conf. Robotics and Automation 3508-3513, 1996 and Chew, L., "Guaranteed-quality mesh generation for curved surfaces", Proc. Ninth annual Symposium on Computational Geometry, 274-280, 1993). This can also be used with a tree search for object recognition. (Beccari et al., "Pose-independent recognition of convex objects from sparse tactile data", Proc. IEEE Int. Conf. Robotics and Automation 3397-3402, 1997). While a mesh is an effective representation of a general surface, it requires dense data and it is therefore not applicable for sparse tactile data problems. An alternative approach represents surface geometry as a composition of geometric primitives, such as planes, cylinders, and spheres. These primitives are often determined with curve and surface fitting methods. (Allen et al., "Acquisition and interpretation of 3-D sensor data from touch", IEEE Trans. Robotics and Automation 6(4): 397-404, 1990 and Pribade et al., "Exploration and dynamic shape estimation by a robotic probe", IEEE Trans. Systems, Man and Cybernetics 19(4): 840-846, 1989). Alternatively, they can be determined using differential invariants. (Keren et al., "Recognizing 3D objects using tactile sensing and curve invariants", J. Mathematical Imaging and Vision 12(1), 5-23, 2000). In this particular approach, when a series of grid points are found to belong to the same fitted curve or surface, the spacing between subsequent data points is increased. This method is still tied to the grid sampling concept and therefore inherently uses dense data.

All of the methods developed for both an intelligent exploration and the characterization of general unknown geometries have not been integrated to achieve fast geometry characterization with sparse data. The present invention address the problems of the prior art, in particular, the general problem of intelligent tactile exploration of constrained internal geometries where time is a key factor.

SUMMARY OF THE INVENTION

In accordance with a first aspect, a method to identify and relatively fast map the shape and location of unknown surfaces is disclosed the method comprising a number of steps. The first step attaches a tactile inspection manipulator base to an unknown surface. The tactile inspection manipulator using an end effector touches the unknown surface. A control unit which is capable of receiving tactile information from the at least one end effector uses the tactile information to reconstruct a surface model based on the tactile information received from the at least one end effector. The control unit also determines the direction the tactile inspection manipulator moves to probe further data points.

In accordance with a further aspect a method for determining an optimum direction for a tactile inspection manipulator is disclosed comprising the steps of:

a: moving the tactile inspection manipulator in a random direction;

b: probing the unknown surface for data points to identify a geometric primitive;

c: choosing a new direction for the tactile inspection manipulator and moving along a chosen line until a new data point is probed;

d: repeating step b if the probed data is a known geometric primitive or repeating step c if the probed data is not a known geometric primitive.

Advantages of disclosed embodiments are that they can be used to identify unknown surfaces. A further advantage is the search algorithm maximizes the amount of information provided by each data point and thereby minimizes the number of data points needed to identify an unknown surface.

Further features and advantages of the invention will become more readily apparent from the following detailed description when taken in conjunction with the accompanying drawings.

BRIEF DESCRIPTION OF THE DRAWINGS

The subject matter disclosed is further described in the detailed description which follows, in reference to the noted plurality of drawings by way of non-limiting examples of exemplary embodiments of the subject matter disclosed, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the embodiments of the subject matter disclosed only and are presented in the cause of providing what is believed to be the most useful and readily understood description of the principles and conceptual aspects of the subject matter disclosed. In this regard, no attempt is made to show structural details of the subject matter disclosed in more detail than is necessary for the fundamental understanding of the subject matter disclosed, the description taken with the drawings making apparent to those skilled in the art how the several forms of the subject matter disclosed may be embodied in practice. Further, like reference numbers and designations in the various drawings indicate like elements.

Embodiments of the subject matter disclosed relate to the location and entry of a lateral hydrocarbon well from a main wellbore in a subterranean formation. Embodiments of the subject matter disclosed further relate to using a robotic tactile inspection manipulator lowered into the well to measure the junction location and geometry by probing.

Exploration and measurements using tactile data presents unique challenges. Tactile data is expensive in terms of time. One visual image can very quickly provide thousands of data points for an object surface. Efficient tactile characterization requires intelligently selecting where to search for new touch points. The subject matter disclosed may among other things maximize the amount of new information provided by each data point and thereby minimize the number of data points needed to generate the map of a given geometry. Embodiments of the subject matter disclosed can substantially reduce the data acquisition effort for a robotic tactile inspection manipulator.

Figures 1A, 1B:
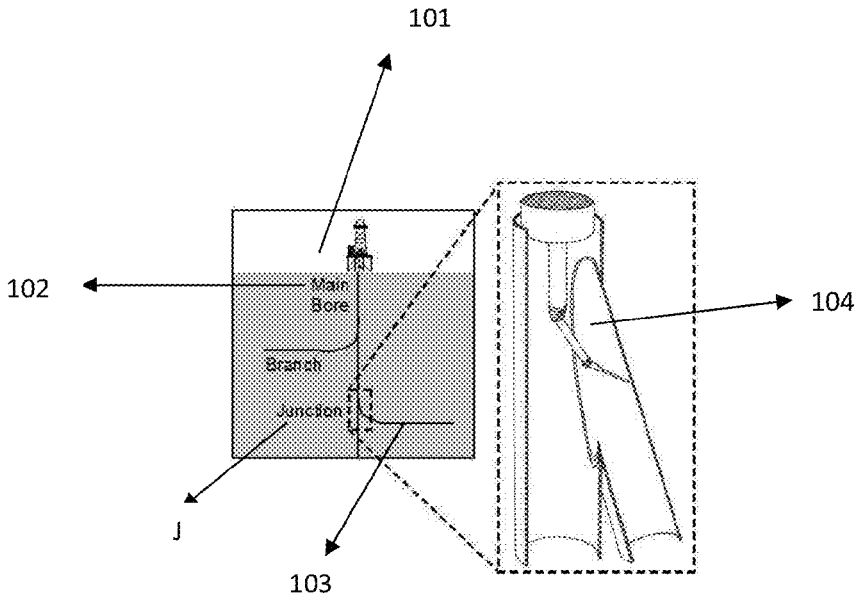
FIG. 1A is a schematic representation illustrating entry of a deployed tactile inspection manipulator.
FIG. 1B is a cutaway schematic of a junction showing a deployed tactile inspection manipulator.

Referring generally to FIGS. 1A and 1B, these illustrate an oil well branching structure and a cutaway detail of a junction showing the deployed tactile inspection manipulator. In particular, there is shown in FIG. 1A a segment or portion of a multilateral wellbore (101) having a vertical main well bore (102), with a lateral bore (103) connecting at a junction J. FIG. 1B shows a schematic cutaway detail of a junction J showing the deployed tactile inspection manipulator (104) which embodies aspects of the subject matter disclosed.

Embodiments of the subject matter disclosed comprise a mobile robotic tactile inspection manipulator and at least one method to identify and relatively fast map the shape and location of geometries. In an embodiment the at least one method can be used to identify and relatively fast map the location of geometries (e.g., surfaces, profiles and volumes) about which none or little prior information is known. It is noted that the foregoing examples have been provided merely for the purpose of explanation of geometries that can be identified and relatively fast mapped and are in no way to be construed as limiting of the present subject matter disclosed. Methods of the subject disclosure can be used to identify and relatively fast map the shape and location of geometries surrounding the robot (surrounding geometries) or geometries that can be surrounded by the robot (surrounded geometries). The constrained surrounding geometries can be one of, for example, the internal geometry of downhole wells, the internal passages in nuclear facilities, pipelines, subsea structures placed on the sea floor for subsea exploration, micro devices or hardware in micro manufacturing facilities, jigs and fixtures for holding parts in manufacturing plants, structures in abandoned buildings that are not accessible and need to be identified or rescue missions in areas that cannot be illuminated for regular video recording robots. The above examples are intended to be illustrative of constrained geometry external to the robot and are not intended to provide an exhaustive list. Examples of surrounded geometries can be objects which may need to be inspected in a factory or a blowout preventer laying on the sea floor of a subsea oilfield operation, etc.

Embodiments of the subject matter disclosed comprise a method to identify and relatively fast map the shape and location of geometries. The method may further comprise using surface fitting to characterize the geometries, subject to the assumption of sparse data collection. The environment to be mapped can be assumed to be composed of the intersection, in the mathematical sense, of a set of basic primitives. The method builds the model as the data is acquired. Searching for additional points is directed based on the information obtained at the particular point in the method. The algorithm searches for new data in directions where little information has been previously gathered. The algorithm minimizes the time and distance traveled by the tactile inspection manipulator end-point, to reconstruct an unknown surface to a given accuracy.

Figure 2:
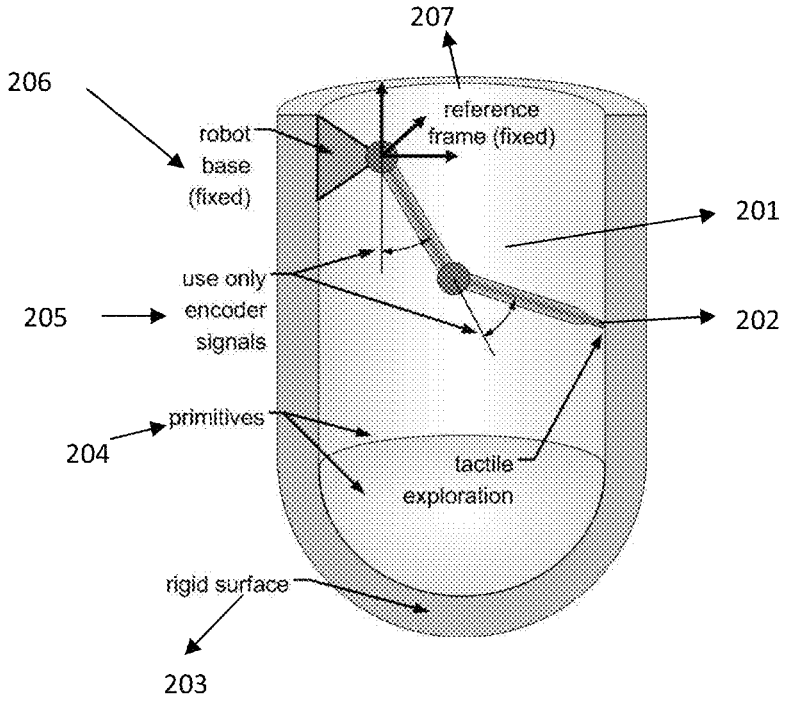
FIG. 2 is a schematic representation of a deployed tactile inspection manipulator in a generic environment.

FIG. 2 depicts an embodiment of the subject matter disclosed inside a generic arbitrarily shaped environment. The tactile inspection manipulator (201) of the embodiment comprises a base (206) attached to the arbitrarily shaped environment (203). The arbitrary shaped environment can have any solid consistency for example: steel, rock, wood, etc. The above examples are intended to be illustrative and do not provide an exhaustive list. In an embodiment, the arbitrarily shaped environment (203) may be assumed to be rigid. It is noted that the environment may not be rigid and other environments may be substituted for those set forth herein without departing from the spirit and scope of the subject matter disclosed. The representation of the arbitrarily shaped environment (203) may be based on constructive solid geometry and comprise a combination of the following geometric primitives (204) planes, spheres, cylinders, cones and tori. The combination of the listed geometric primitives is general enough for representing the arbitrarily shaped environment (203) and for most arbitrarily shaped environments (203). Situations may arise where none of the geometric primitives listed represent an arbitrarily shaped environment (203). In these situations generalizations to further shapes may be achieved by implementing blends between geometric primitives and splines can be locally used in situations where no geometric primitives (204) represent the real shape. In a preferred embodiment it may be assumed that a parameter representing the minimum size of the geometric primitives (204) is provided which guarantees the algorithms search to be computed in finite time. Referring to FIG. 2 the tactile inspection manipulator (201) touches the surface of the arbitrarily shaped environment (203) with its tip (202). The tip (202) is any end effector that is used in robots. In serial manipulators, these end effectors could be a hand, rounded ends, etc. By touching the surface (203) with its tip (202) the tactile inspection manipulator (201) autonomously collects data points. Data points are submitted to a computer algorithm or a control unit to reconstruct the environment shape (203) within a given accuracy. In an embodiment of the subject matter disclosed it is noted that the tactile inspection manipulator (201) can tactily create a map of the arbitrarily shaped environment (203) with the minimum travel of the tactile inspection manipulator (201). In an embodiment of the subject matter disclosed it is possible for the tactile inspection manipulator (201) to comprise sensors (205) and the computer algorithm can only use information about the tactile inspection manipulator (201) links relative positions. Information from sensors (205) at the tactile inspection manipulator (201) joints is used to determine the tactile inspection manipulator (201) links relative positions. The reference frame (207) is fixed with respect to the rigid surface (303).

It is noted that the subject matter disclosed provides for fast characterization of the large-scale elements of a general geometry. The characterization can be utilized to guide intensive small-scale tactile exploration to areas of interest, such as the lip of a junction in an oil well. Touch measurements may contain inaccuracies due to non-ideal surfaces and to measurement noise.

According to the subject matter disclosed at least one method can identify and relatively fast map the shape and location of geometries and further comprise the steps of reconstructing a surface and an exploration step or a navigational step both steps being performed simultaneously. Surface reconstruction is a method whereby with a finite number of touch points collected so far an approximation of the shape of the geometry can be produced. Exploration step of the method comprises given the information gathered and the current model, determining the best path for the robot in order to complete the exploration with minimum movements.

One of the objectives of surface reconstruction can be to represent a surface given a finite number of points touched on the surface. The process of surface reconstruction can be iterated every time a new point is measured and the surface model is re-evaluated. Surface reconstruction can be divided into three parts:

1. Fitting

First Fitting, where the tactile inspection manipulator (201) collects touch points belonging to some geometric primitive (204) S(θ), where θ is the set of the primitive's parameters. The computer algorithm finds the best value of θ that approximates the collected touch points or data using a least squares fit, minimizing the sum of the squared distances between the primitive and the points. (see Equation 1 below).

$$\theta = \arg\min_{\theta} \sum_{i=1}^{N} d(P_i, S(\theta))^2 \qquad \text{Equation 1}$$

The computer algorithm repeats the process for all of the geometric primitives (204) in the library of geometric primitives to determine the best representation of the arbitrarily shaped environment (203). For geometric primitives other than planes and spheres iterative methods are used. In an embodiment of the subject matter disclosed the iterative method can project data points onto a plane reducing the dimension of the required nonlinear search.

2. Segmentation

The second step of surface reconstruction is Segmentation which identifies the different primitives in the set of data points collected and classifies the set of data points collected so that each data point belongs to only one geometric primitive. (Petijean, S., "A survey of methods for recovering quadrics in triangle meshes", ACM Computing Surveys 34(2): 211-262, 2002). In an embodiment of the subject matter disclosed, segmentation comprises two steps with the first step comprising only a few data points per geometric primitive. The second step comprises adding data points to the dataset gradually. The computer algorithm in the embodiment allows an incremental reconstruction. The computer algorithm must also tolerate the presence of outliers. Outliers occur when a geometric primitive has been partially discovered. In an embodiment, the algorithm selects small initial regions (seeds) and evaluates these small initial regions (seeds) against all of the known geometric primitives. Seeds that give a good fit are gradually expanded while the fit itself is gradually refined, until all the points belonging to the same geometric primitive are assembled. In an embodiment, the computer algorithm is implemented and optimized for sparse data and incrementally added data points.

3. Mapping Intersections of the Geometric Primitives

After the geometric primitives have been identified, their intersections are modeled to produce the complete representations. This is the third step of surface reconstruction. Mapping the intersection of the geometric primitives describes the shape or contour of the intersections.

Exploration Step/Navigational Step

Figure 3A:
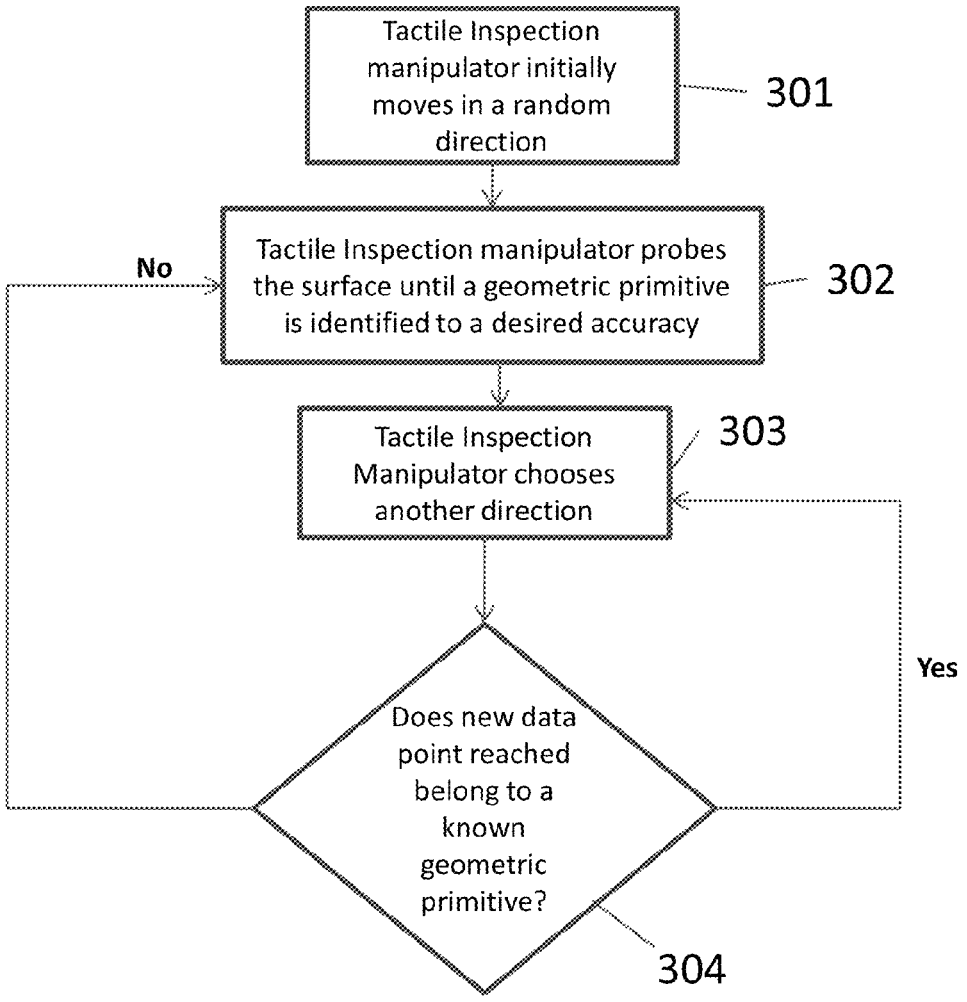
FIGS. 3A and 3B are a flow chart and a schematic representation respectively, of the Best Cone strategy of an embodiment of the subject matter disclosed.

An embodiment of the subject matter disclosed comprises the step of guiding the tactile inspection manipulator based on the gradual interpretation of sequentially-acquired data. This simple technique which is called the Best Cone Strategy (BCS) maps a generic environment with a shorter end effector path and in a shorter timeframe. The shorter end effector path is the path with minimum total length. The BCS moves the tactile inspection manipulator so that each measurement gives the most information. An embodiment of the Best Cone Strategy (BCS) is depicted in FIG. 3A and comprises the following steps:

1. The tactile inspection manipulator initially moves in a random direction (301).
2. The tactile inspection manipulator locally probes the generic environment reached until a geometric primitive is identified to a desired accuracy (302).
3. Tactile inspection manipulator chooses another direction, based on the algorithm of step 4 below (304), and moves along a designated line until it touches a new data point (303).
4. If the data point reached belongs to a known geometric primitive, it will repeat step 3 (303), otherwise, it will repeat step 2 (302) before continuing the search in a new direction by repeating step 3 (303).

Figure 3B:
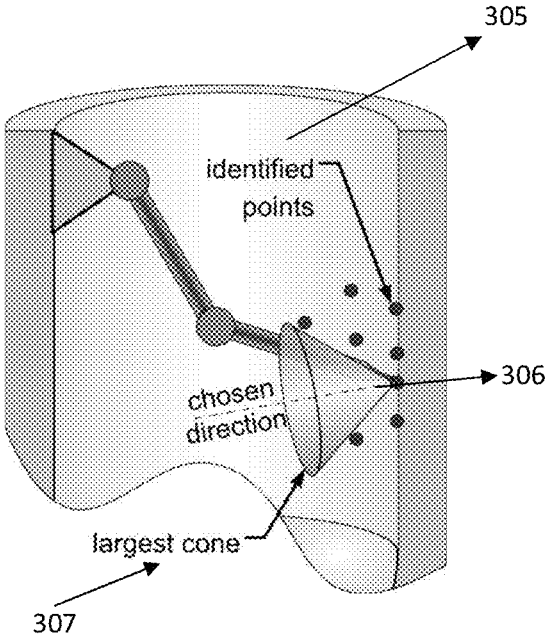

The direction of step 3 (303) is chosen to maximize the expected amount of information given by the next measurement. In an embodiment of the subject matter disclosed to achieve the steps of the method a computer algorithm is used. FIG. 3B is at least one representation of the best cone strategy. The computer algorithm moves the tactile inspection manipulator in a direction (306) that is away from all previously touched points. The computer algorithm computes all the possible circular cones (307) with vertex at the end position $P_{ee}$ and subject to the constraint that all the probed points Pi (305) are external to the cone. The cone with the largest aperture angle is chosen, and its axis N (306) is the next direction of the tactile inspection manipulator. This is represented in the Equation 2 below.

$$\overline{N} = \arg\max_{\vec{N}}\left\{\min_{i}\left(\overline{N}\cdot\frac{\overrightarrow{P_{ee}-P_i}}{\|P_{ee}-P_i\|}\right)\right\} \quad \text{Equation 2}$$

The internal minimization determines for a given direction N the largest cone aperture that includes no data touch points. The external maximization chooses N to maximize this angle. The computer algorithm evaluation is computationally fast as the search involves just the variables representing the cone axis. The geometric primitives do not affect the choice. In some embodiments of the subject matter disclosed, the intersections between geometric primitives require greater accuracy which is achieved by detailed exploration along these intersections after initial identification.

Figure 4:
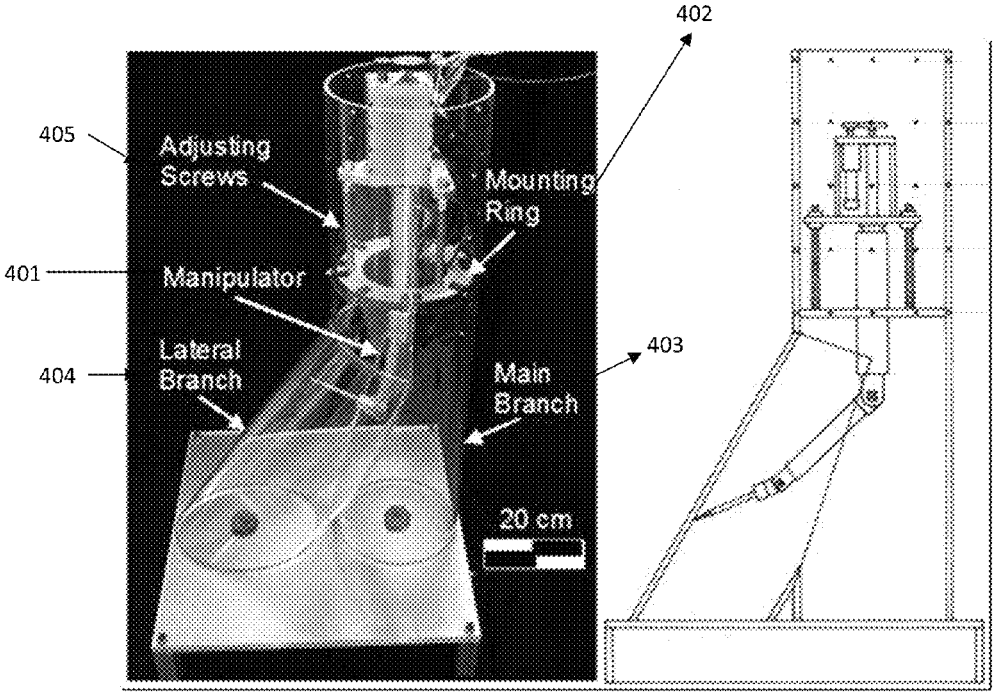
FIG. 4 shows a laboratory prototype of an experimental tactile inspection manipulator in an oil well junction.

FIG. 4 shows an embodiment of an experimental tactile inspection manipulator in a model oil well junction. The size and kinematics configuration are representative of a well junction field system. The tactile inspection manipulator is controlled by a simple impedance controller. This permits the tactile inspection manipulator to press against the junction surfaces without using any force-torque sensors. Utilizing force-torque sensors which would have the ability to function in a very hostile down-hole environment would be difficult and prohibitively expensive. Impedance control is used to hold the tactile inspection manipulator against the generic environment. The control unit or computer algorithm can determine the position of the probe tip and therefore the surface can then be determined by sensing joint angles. The position of the tactile end effector tip determines the set of relative angles between any two consecutive links in the robot (joint angles). Therefore, when the robot obtains the tactile end effector tip position coordinates, it can infer the joint angles. Simple manipulator link arrangements (401) which have closed form inverse kinematic solutions make the implementation of impedance control easy. Kinematic solutions are a set of values for the joint angles given an end effector or tip position coordinates. Some kinematics solutions for a given end effector position are simple closed form solutions, others are not, they are more complex. Closed form expressions have a single set of joint angle values for a given end effector (tip) position. Some embodiments may require more complex kinematic designs.

In an embodiment of the subject matter disclosed it is possible the tactile inspection manipulator is fixed with respect to the generic environment being explored. Compliant anchoring systems or deployable structures can be utilized to fix the tactile inspection manipulator to the generic environment being explored. For example, see "Anchoring System and method", filed Nov. 15, 2005, Ser. No. 11/273,758, which is hereby incorporated by reference in its entirety. These compliant anchoring systems can conform to any cross sectional topology and expand to variable diameter ratios and once expanded exert normal forces on the casing or formation. This allows the anchoring system to produce large anchoring forces when combined with the friction coefficient between the anchoring system and the casing or formation. These anchoring systems are retractable and therefore they can be used to anchor the tactile inspection manipulator. Once the tactile inspection manipulator is anchored the tactile inspection manipulator can explore the generic environment. At any time the anchoring system can be unsecured allowing the anchoring system and the tactile inspection manipulator to move axially in the well for further exploration.

In an embodiment of the subject matter disclosed it is noted the tactile inspection manipulator can be mounted on a cylindrical tool module that is lowered into the well. The cylindrical tool module will bind itself to the wellbore above the junction using different types of anchoring mechanisms, non-limiting examples include a compliant anchoring system or a deployable structure.

In one example an embodiment is used in a well junction that has 22.9 cm and 17.8 cm diameter main and lateral bores respectively with a divergence angle of 5°. The junction would be approximately 203 cm long. To fully explore this long and narrow junction space the embodiment of the tactile inspection manipulator requires a redundant manipulator. A fourth degree-of-freedom (DOF) mechanism consisting of a third degree-of-freedom anthropomorphic arm attached to a long prismatic link aligned with the axis of the main well bore is well suited. Experimental results have been carried out with the third degree-of-freedom arm.

In an embodiment of the subject matter disclosed it is noted the manipulator end effector can be a passive tactile probe. The sizing of the arm links is based on the workspace size and dexterity requirement inside of an oil well. Links are stiff enough to ensure link deformations introduce negligible error in the measuring of the position of the probe tip. As mentioned earlier, in some embodiments a prismatic fourth degree of freedom would be required to enable the manipulator to reach down the length of a long and narrow oil well junction.

FIG. 4 shows a laboratory prototype of the tactile inspection manipulator (401) prototype (401) where the prismatic joints are replaced with a series of mounting positions in the generic environment and threaded mounting rods in the manipulator mounting rings (402). Screws (405) are used to anchor the tactile inspection manipulator to the mounting ring (402) and the main branch (403), comprised of Plexiglass pipe, represents the main well. Each joint assembly in this third degree-of-freedom embodiment consists of a motor, gear train, encoder, and associated support bearings. Brushed DC motors may also be used. It is important that the joints are compact to minimize the potential for undesirable contact between the manipulator elbow and the environment being probed. Joints may also be sealed to protect them from drilling mud used in oil wells.

Figure 5:
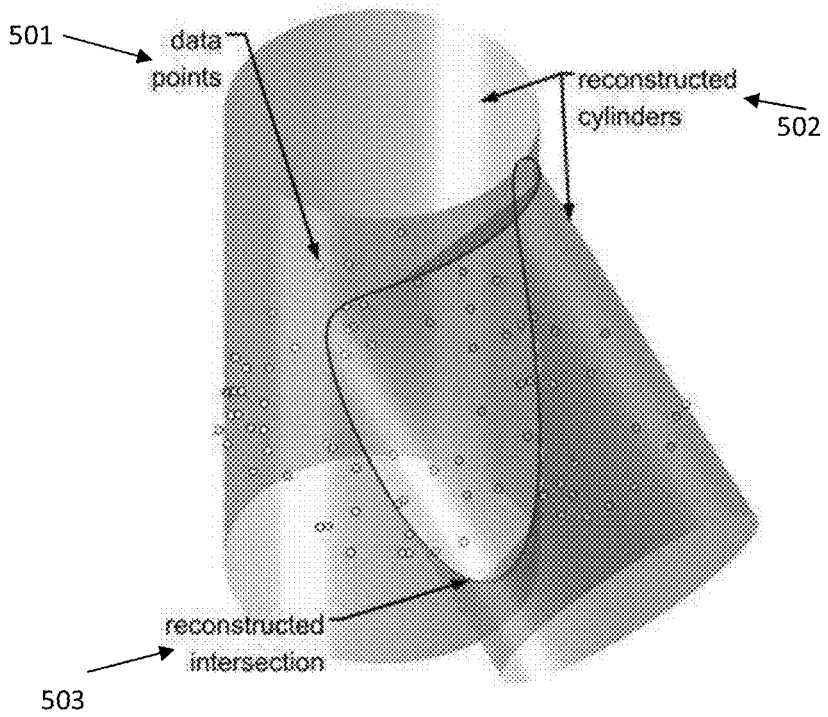
FIG. 5 is a schematic representation of the data search points for a Uniform Surface Density search.

FIG. 5 shows the pattern of experimental touch points produced by the Uniform Surface Density Search. The reconstructed cylinders (502) fit to the touch data points (501). Once the geometric primitives, in this case, a reconstructed cylinder (502) have been identified, the reconstructed intersection (503) needs to be modeled to produce the complete representation. The results of the surface modeling are shown in Table 1 below. Table 1 shows preliminary experimental results for both the Uniform Surface Density search and the Best Cone Search. The computer algorithm was able to successfully map the two well elements as cylinders with about 3% accuracy. In the case of the Surface Density Search it took 76 touch data points to achieve this accuracy. The tactile inspection manipulator traveled 8.16 m to make these measurements over a period of 556 s.

TABLE I

| Method | Cylinder 1 Radius (119 mm) | Cylinder 2 Radius (119 mm) | Number of Points required | Distance Traveled by Manipulator | Time |
|---|---|---|---|---|---|
| Uniform Surface Density | 122 mm | 119 mm | 76 | 8 Meters | 556 s |
| Best Cone | 122 mm | 118 mm | 26 | 4 meters | 169 s |

Figure 6:
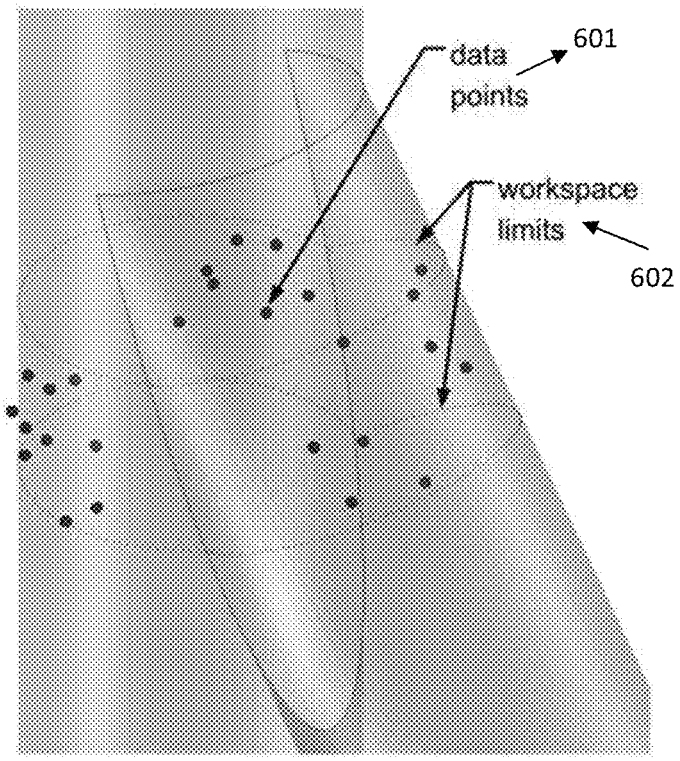
FIG. 6 is a schematic representation of the data search points for a Best Cone Search.

FIG. 6 shows the search points for a Best Cone Search. The workspace of a robot is the entire area that the robot end effector can reach. The outer bounds of that workspace are called workspace limits (602). Table 1 above, shows that the number of experimental data points for the Best Cone method was reduced to 26 and the total distance traveled was reduced by half. The required time was reduced greatly to 169 s or 30% of the time required by the Uniform Surface Density Search.

Figure 7:
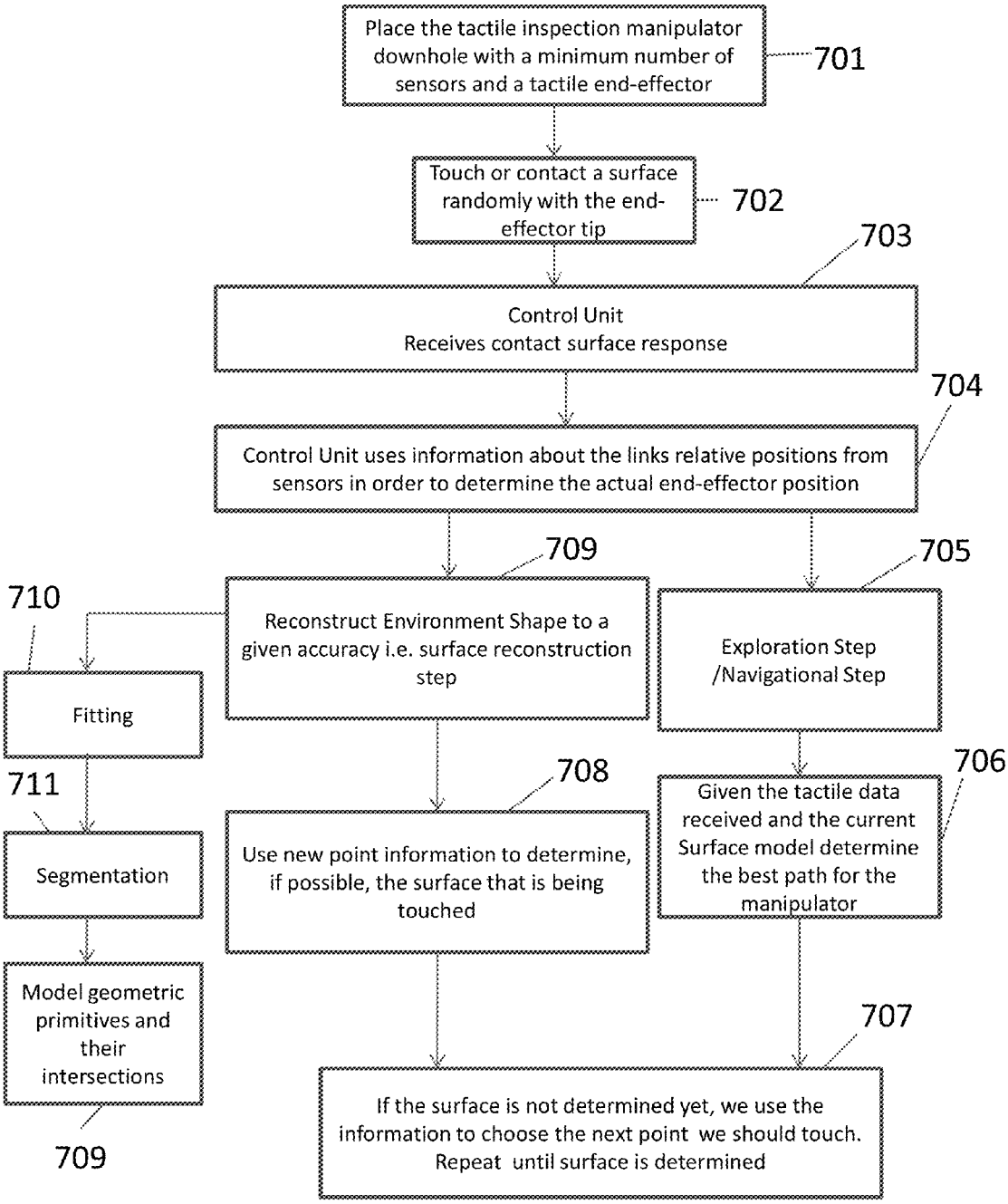
FIG. 7 is a flow chart illustrating an embodiment of the subject matter disclosed.

FIG. 7 shows a flow chart of an embodiment of the subject matter disclosed. The tactile inspection manipulator (701) is placed in a downhole environment with a minimum number of sensors. The tactile inspection manipulator randomly touches or contacts a surface with an end effector tip (702). The control unit receives the contact surface response (703) and the control unit uses information about the tactile inspection manipulator links relative positions from sensors in the tactile inspection manipulator to determine the actual end effector position. Two steps are then carried out the reconstruction step (709) and the exploration step or navigational step (705). Both of these steps are carried out simultaneously. The reconstruction step comprises three steps the fitting (710), segmentation (711) and the modeling the geometric primitives and their intersections step (709). During the reconstruction step the algorithm uses new touch points data to determine, if possible, the surface that is being touched (708). The navigational step (705) determines the best path for the tactile inspection manipulator (706) given the tactile data received and the current surface model (706). If the surface is not determined the information received by the control unit is used to choose the next data point to be touched and this process is repeated until the surface is determined (707).

The embodiments of the subject matter disclosed can be used to find perforations, with no previous information regarding their position, made in cased wells for oil exploration and once located filters and sensors can be placed in each of these perforations in order to perform sand production prevention and sand control sensing. The embodiments of the subject matter disclosed can also be used for locating a shape of a lateral wellbore for passing a tool e.g. a logging tool or for example in completions for identifying e.g. valves.

Whereas many alterations and modifications of the subject matter disclosed will no doubt become apparent to a person of ordinary skill in the art after having read the foregoing description, it is to be understood that the particular embodiments shown and described by way of illustration are in no way intended to be considered limiting. Further, the subject matter disclosed has been described with reference to particular embodiments, but variations within the spirit and scope of the subject matter disclosed will occur to those skilled in the art. It is noted that the foregoing examples have been provided merely for the purpose of explanation and are in no way to be construed as limiting of the present subject matter disclosed. While the subject matter disclosed has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the subject matter disclosed in its aspects. Although the subject matter disclosed has been described herein with reference to particular means, materials and embodiments, the subject matter disclosed is not intended to be limited to the particulars disclosed herein; rather, the subject matter disclosed extends to all functionally equivalent structures, methods and uses, such as are within the scope of the appended claims.

What is claimed is:

1. A method to identify one or more unknown surfaces in a wellbore, the method comprising:

attaching at least one tactile inspection manipulator to the one or more unknown surfaces;

touching the one or more unknown surfaces with at least one end effector of the at least one tactile inspection manipulator to obtain tactile data;

communicating and storing the tactile data from the at least one tactile inspection manipulator to a control unit;

using the control unit to process the received tactile data to identify the one or more unknown surfaces and the location of the one or more unknown surfaces; and wherein the control unit uses an algorithm to obtain the tactile data wherein the algorithm searches for new tactile data in a direction away from previously touched points.

2. The method of claim 1 wherein the control unit operatively controls a direction of the end effector upon receiving the tactile data.

3. The method of claim 2 wherein the direction is controlled based on the tactile data received at a particular point.

4. The method of claim 2 wherein the method to operatively control the direction for the tactile inspection manipulator to move uses a cone search algorithm.

5. The method of claim 1 wherein the tactile data includes one or a plurality of data points.

6. The method of claim 5 wherein the one or a plurality of data points determines a geometry and the location of the one or more unknown surfaces.

7. The method of claim 5 further comprising constructing a surface model of the one or more unknown surfaces from the one or a plurality of data points.

8. The method of claim 7 wherein constructing a surface model is iterated every time a data point is touched and the surface model is re-evaluated.

9. The method of claim 7 wherein the step of constructing a surface model is based on geometric primitives.

10. The method of claim 9 wherein the geometric primitives are selected from the group consisting of planes, spheres, cylinders, cones and tori.

11. The method of claim 7 wherein the step of constructing a surface model is based on blends between geometric primitives or splines.

12. The method of claim 7 wherein the step of constructing a surface model further includes the steps of:

fitting the surface model;

segmenting the surface model so that each of the data points fits to one geometric primitive; and modeling the geometric primitive intersection to produce a complete surface model.

13. The method of claim 5 wherein identifying the one or more unknown surfaces includes incrementally adding one or a plurality of data points.

14. The method of claim 1 wherein the control unit receives the tactile data from one or a plurality of sensors located on one or more joints on the tactile inspection manipulator.

15. The method of claim 14 wherein the one or a plurality of sensors includes Encoder Signals.

16. The method of claim 1 wherein the tactile data is used to determine the tactile inspection manipulator links relative position.

17. The method of claim 1 wherein the unknown surface is one of a rigid surface, semi-rigid surface or some combination thereof.

18. The method of claim 1 wherein the unknown surface is a wellbore surface.

19. The method of claim 18 wherein the wellbore surface is one of a lateral wellbore, a vertical wellbore or some combination thereof.

20. The method of claim 1 wherein the control unit calculates a parameter which represents the minimum size of a geometric primitive.

21. The method of claim 1 wherein the attaching step uses compliant structures.

22. The method of claim 1 wherein the direction is selected based on minimizing a distance traveled by the at least one end effector.

23. A method for determining an optimum direction for a tactile inspection manipulator comprising the steps of:

a) moving the tactile inspection manipulator in a random direction in a wellbore;

b) probing an unknown surface for data points to identify a geometric primitive;

c) choosing a new direction for the tactile inspection manipulator and moving along a chosen line until a new data point is probed; and d) repeating step b if the probed data is a known geometric primitive or repeating step c if the probed data is not a known geometric primitive; and e) identifying the unknown surface using a minimum number of data points.

24. The method of claim 23 wherein the new direction is chosen to move away from previously probed data points.

* * * * *